US011465026B2

(12) United States Patent
Gibb

(10) Patent No.: US 11,465,026 B2
(45) Date of Patent: Oct. 11, 2022

(54) APPARATUS AND METHODS FOR GOLF STROKE TRAINING

(71) Applicant: Robb Gibb, Endwell, NY (US)

(72) Inventor: Robb Gibb, Endwell, NY (US)

(73) Assignee: Perfection Platforms, Ltd., Endwell, NY (US)

( * ) Notice: Subject to any disclaimer, the term of this patent is extended or adjusted under 35 U.S.C. 154(b) by 0 days.

(21) Appl. No.: 17/594,129

(22) PCT Filed: Nov. 13, 2019

(86) PCT No.: PCT/US2019/061062
§ 371 (c)(1),
(2) Date: Oct. 4, 2021

(87) PCT Pub. No.: WO2020/205000
PCT Pub. Date: Oct. 8, 2020

(65) Prior Publication Data

US 2022/0088457 A1 Mar. 24, 2022

Related U.S. Application Data

(60) Provisional application No. 62/829,326, filed on Apr. 4, 2019.

(51) Int. Cl.
*A63B 69/36* (2006.01)
*A63B 24/00* (2006.01)

(52) U.S. Cl.
CPC ..... *A63B 69/3661* (2013.01); *A63B 24/0003* (2013.01); *A63B 2024/0031* (2013.01);
(Continued)

(58) Field of Classification Search
CPC ..... A63B 69/3661; A63B 24/0003; A63B 2024/0031; A63B 2214/00;
(Continued)

(56) References Cited

U.S. PATENT DOCUMENTS 1,612,291 A 12/1926 Jackson
3,522,947 A 8/1970 Anderson et al.
(Continued)

FOREIGN PATENT DOCUMENTS

WO 2005032670 A1 4/2005

OTHER PUBLICATIONS

Putting Perfection Platform, "Arizona State University's new automated custom design with PuttView. #perfection platforms", Sep. 19, 2018, online, retrieved from https://www.facebook.com/puttingperfectionplatforms.

*Primary Examiner* — Jeffrey S Vanderveen
(74) *Attorney, Agent, or Firm* — Hinman, Howard & Kartell, LLP

(57) ABSTRACT

Golf stroke training apparatus, as well as methods and systems to train a golfer to improve golf strokes, including putting strokes, wherein the golf stroke training apparatus provides a planar surface that can be levelled statically to the surface below it and el can be adjusted by adding slope and/or pitch in quantifiable measurements and with a high degree of accuracy, wherein the repeatable golf stroke environments so provided permit repeatable and quantifiable golfer stroke actions and analysis and leading to golf stroke consistency.

13 Claims, 12 Drawing Sheets

(52) U.S. Cl.
CPC ..... *A63B 2214/00* (2020.08); *A63B 2220/18* (2013.01); *A63B 2220/20* (2013.01); *A63B 2220/52* (2013.01); *A63B 2220/833* (2013.01); *A63B 2225/093* (2013.01)

(58) Field of Classification Search
CPC ..... A63B 2220/18; A63B 2220/20; A63B 2220/52; A63B 2220/833; A63B 2225/093
See application file for complete search history.

(56) References Cited

U.S. PATENT DOCUMENTS 3,658,343 A 4/1972 Rogers et al.
3,892,412 A * 7/1975 Koo ..... A63B 69/3661 473/160
4,114,887 A 9/1978 Delraso
4,898,388 A 2/1990 Beard, III et al.
5,301,947 A * 4/1994 Kim ..... A63B 67/02 473/163
5,518,245 A 5/1996 Nelson
5,733,200 A 3/1998 Kim
6,056,645 A * 5/2000 Servatius ..... A63B 67/02 473/162
6,623,370 B1 9/2003 Willer
6,663,498 B2 12/2003 Stipan
6,942,579 B2 * 9/2005 Chen ..... A63B 67/02 473/161
7,749,092 B2 * 7/2010 Rutherford ..... A63B 69/3676 473/359
8,616,988 B1 * 12/2013 Coffman ..... A63B 24/0003 473/150
9,802,100 B2 10/2017 Csencsits
10,112,099 B2 10/2018 Craig et al.
2003/0040373 A1 2/2003 Chamberlain et al.
2005/0197196 A1 9/2005 Ostiguy
2010/0184496 A1 7/2010 Nicora
2011/0192096 A1 * 8/2011 Koberinski ..... E04B 5/43 52/126.6
2013/0047453 A1 2/2013 Rife
2013/0116059 A1 * 5/2013 Yeh ..... A63B 69/3661 473/160
2014/0038740 A1 * 2/2014 Wanner ..... A63B 69/3652 473/409
2014/0073445 A1 * 3/2014 Flammer ..... A63B 69/3676 473/409
2015/0005085 A1 * 1/2015 Tatum ..... A63B 67/02 473/166
2016/0158640 A1 * 6/2016 Gupta ..... G09B 9/006 463/3
2017/0080315 A1 3/2017 Anglin
2018/0318688 A1 11/2018 Colangelo
2019/0105536 A1 * 4/2019 Claessen ..... A63B 24/0021
2019/0134506 A1 * 5/2019 Gupta ..... G09B 19/0038

* cited by examiner

APPARATUS AND METHODS FOR GOLF STROKE TRAINING

CROSS REFERENCE TO RELATED APPLICATION

The present application relates to and claims priority from International Patent Application No. PCT/US19/61062, filed on 13 Nov. 2019 and U.S. Provisional Application No. 62/829,326 filed on Apr. 4, 2019, the entire disclosures of which are incorporated herein by reference in their entireties.

BACKGROUND

This disclosure relates to the field of golf stroke training devices and, specifically, to golf putting stroke training devices that improve a golfer's putting stroke. Improving one's golf putting stroke is important because nearly one-half of all strokes counted in a par round of golf are putting strokes. It is known in the field that the most effective golf players have developed putting strokes that are consistent and repeatable. Although a typical golf course is about seven-thousand yards long, it is the last several yards of putting strokes that truly require a high degree of skill since there is little room for error. Known golf stroke training devices and related methods suffer from multiple disadvantages and problems, including, inter alia, being ineffective at improving golf strokes and putting strokes, providing imprecise devices that lack the ability to accurately reproduce golf stroke conditions, and inconsistently attempting to provide golf stroke training, and other multiple disadvantages and problems that are known to one of ordinary skill in the relevant art of golf stroke training. Thus, there exists a need for novel and improved devices and methods and systems for golf stroke training devices that are not subject to multiple disadvantages and problems of the known apparatuses and methods and systems.

SUMMARY OF INVENTION

An object of the invention is to provide a golf stroke training apparatus, as well as methods and systems to train a golfer to improve golf strokes, including putting strokes, wherein improvements include, inter alia, an increase in consistency and repeatability of the putting strokes, and which novel apparatus and methods and systems of the invention solved the multiple disadvantages and problems of known methods, including as described above, including, inter alia, being ineffective at improving golf strokes and putting strokes, providing imprecise devices that lack the ability to accurately reproduce golf stroke conditions, and inconsistently attempting to provide golf stroke training, and other multiple disadvantages and problems that are known to one of ordinary skill in the relevant art of golf stroke training.

Another object of the invention is to provide a golf stroke training apparatus, as well as methods and systems to train a golfer to improve golf strokes, including putting strokes, wherein the golf stroke training apparatus provides a golf putting stroke surface on which a golfer practices, wherein the slope of the putting stroke surface is adjustable, and which putting stroke surface is a planar surface such that the putting stroke surface can be levelled statically to the supporting frame below the putting stroke surface, and which novel apparatus and methods and systems of the invention solved the multiple disadvantages and problems of known methods, including as described above, including, inter alia, being ineffective at improving golf strokes and putting strokes, providing imprecise devices that lack the ability to accurately reproduce golf stroke conditions, and inconsistently attempting to provide golf stroke training, and other multiple disadvantages and problems that are known to one of ordinary skill in the relevant art of golf stroke training.

In yet another object of the invention is to provide a golf stroke training apparatus, as well as methods and systems to train a golfer to improve golf strokes, including putting strokes, wherein the golf stroke training apparatus provides a golf putting stroke surface on which a golfer practices, wherein the slope of the putting stroke surface is adjustable and which putting stroke surface is a planar surface so that the putting stroke surface can be levelled statically to the supporting frame below it, and wherein the static level can then be adjusted by adding slope and/or pitch in quantifiable measurements, and in another object of the invention, adjusting in quantifiable measurements to less than about one-tenth of a degree or about 0.3 percent of slope, and which novel apparatus and methods and systems of the invention solved the multiple disadvantages and problems of known methods, including as described above, including, inter alia, being ineffective at improving golf strokes and putting strokes, providing imprecise devices that lack the ability to accurately reproduce golf stroke conditions, and inconsistently attempting to provide golf stroke training, and other multiple disadvantages and problems that are known to one of ordinary skill in the relevant art of golf stroke training.

In yet another object of the invention is to provide a golf stroke training device, as well as methods and systems to train a golfer to improve golf strokes, including putting strokes, wherein a golf stroke training apparatus with a golf putting stroke surface on which a golfer practices, wherein the slope of the putting stroke surface is adjustable and which putting stroke surface is a planar surface so that the putting stroke surface can be levelled statically to the supporting frame below it, and wherein the static level can then be adjusted by adding slope and/or pitch in quantifiable measurements, and wherein scientific instrumentation and/or software technology can be coupled with the putting stroke surface so as to measure, regarding the golfer on the stroke training apparatus, weight distribution, ground force reaction, stroke analysis, ball launch, roll and distance, and wherein another object of the invention the scientific instrumentation and/or software technology can be coupled with the putting stroke surface so as to measure with a high degree of accuracy, and which novel apparatus and methods and systems of the invention solved the multiple disadvantages and problems of known methods, including as described above, including, inter alia, being ineffective at improving golf strokes and putting strokes, providing imprecise devices that lack the ability to accurately reproduce golf stroke conditions, and inconsistently attempting to provide golf stroke training, and other multiple disadvantages and problems that are known to one of ordinary skill in the relevant art of golf stroke training.

In one aspect, the invention provides a golf stroke training apparatus, as well as methods and systems to train a golfer to improve golf strokes, including putting strokes, wherein improvements include, inter alia, an increase in consistency and repeatability of the putting strokes, and which novel apparatus and methods and systems of the invention solved the multiple disadvantages and problems of known methods, including as described above.

In another aspect, the invention provides a golf stroke training apparatus, as well as methods and systems to train a golfer to improve golf strokes, including putting strokes, wherein the golf stroke training apparatus provides a golf putting stroke surface on which a golfer practices, wherein the slope of the putting stroke surface is adjustable, and which putting stroke surface is a planar surface such that the putting stroke surface can be levelled statically to the supporting frame below the putting stroke surface, and which novel apparatus and methods and systems of the invention solved the multiple disadvantages and problems of known methods, including as described above.

In yet another aspect, the invention provides a golf stroke training apparatus, as well as methods and systems to train a golfer to improve golf strokes, including putting strokes, wherein the golf stroke training apparatus provides a golf putting stroke surface on which a golfer practices, wherein the slope of the putting stroke surface is adjustable and which putting stroke surface is a planar surface so that the putting stroke surface can be levelled statically to the supporting frame below it, and wherein the static level can then be adjusted by adding slope and/or pitch in quantifiable measurements, and in another object of the invention, adjusting in quantifiable measurements to less than about one-tenth of a degree or about 0.3 percent of slope, and which novel apparatus and methods and systems of the invention solved the multiple disadvantages and problems of known methods, including as described above.

In yet another aspect, the invention provides a golf stroke training apparatus, as well as methods and systems to train a golfer to improve golf strokes, including putting strokes, wherein the golf stroke training apparatus provides a golf putting stroke surface on which a golfer practices, wherein a golf stroke training apparatus with a golf putting stroke surface on which a golfer practices, wherein the slope of the putting stroke surface is adjustable and which putting stroke surface is a planar surface so that the putting stroke surface can be levelled statically to the supporting frame below it, and wherein the static level can then be adjusted by adding slope and/or pitch in quantifiable measurements, wherein scientific instrumentation and/or software technology can be coupled with the putting stroke surface so as to measure, regarding the golfer on the stroke training apparatus, weight distribution, ground force reaction, stroke analysis, ball launch, roll and distance, and wherein another object of the invention the scientific instrumentation and/or software technology can be coupled with the putting stroke surface so as to measure with a high degree of accuracy, and which novel apparatus and methods and systems of the invention solved the multiple disadvantages and problems of known methods, including as described above.

In yet another aspect, the invention provides a golf stroke training apparatus, as well as methods and systems to train a golfer to improve golf strokes, including putting strokes, wherein the golf stroke training apparatus provides a golf putting stroke surface on which a golfer practices, wherein a golf stroke training apparatus with a golf putting stroke surface on which a golfer practices, wherein the slope of the putting stroke surface is adjustable and which putting stroke surface is a planar surface so that the putting stroke surface can be levelled statically to the supporting frame below it, and wherein the static level can then be adjusted by adding slope and/or pitch in quantifiable measurements, wherein movement of the planar putting stroke surface is performed using a plurality of actuators, such as electric actuators, attached, such as directly attached, to the underside of the planar putting stroke surface, and wherein the plurality of actuators are located at each corner as well as at the middle of the planar putting stroke surface, and wherein the plurality of actuators are coupled with inclinometers and are electronically adjusted with software technology, and wherein scientific instrumentation and/or software technology can be coupled with the putting stroke surface so as to measure, regarding the golfer on the stroke training apparatus, weight distribution, ground force reaction, stroke analysis, ball launch, roll and distance, and wherein another object of the invention the scientific instrumentation and/or software technology can be coupled with the putting stroke surface so as to measure with a high degree of accuracy, and which novel apparatus and methods and systems of the invention solved the multiple disadvantages and problems of known methods, including as described above.

In yet another aspect, the invention provides a golf stroke training apparatus, as well as methods and systems to train a golfer to improve golf strokes, including putting strokes, wherein the golf stroke training apparatus provides a golf putting stroke surface on which a golfer practices, wherein a golf stroke training apparatus with a golf putting stroke surface on which a golfer practices, wherein the slope of the putting stroke surface is adjustable and which putting stroke surface is a planar surface so that the putting stroke surface can be levelled statically to the supporting frame below it, and wherein the static level can then be adjusted by adding slope and/or pitch in quantifiable measurements, wherein movement of the planar putting stroke surface is performed using a plurality of actuators, such as electric actuators, attached, such as directly attached, to the underside of the planar putting stroke surface, and wherein the plurality of actuators are located at each corner as well as at the middle of the planar putting stroke surface, and wherein the plurality of actuators are coupled with inclinometers and are electronically adjusted with software technology, and wherein scientific instrumentation and/or software technology can be coupled with the putting stroke surface so as to measure, regarding the golfer on the stroke training apparatus, weight distribution, ground force reaction, stroke analysis, ball launch, roll and distance, and wherein another object of the invention the scientific instrumentation and/or software technology can be coupled with the putting stroke surface so as to measure with a high degree of accuracy, and wherein the putting stroke surface is covered with synthetic grass carpeting, for example short-nap carpeting used for putting, or for example deeper-nap carpeting for non-putting golf strokes, and wherein the apparatus provides a standard-sized and standard-depth cup for receiving a golf ball, as used on a golf course, and wherein the placement of the cup provides a measured ten-foot putt, as well as an eighteen-inch overrun behind the cup, and wherein overrun provides assistance in speed of the golf ball delivery into the cup, and which novel apparatus and methods and systems of the invention solved the multiple disadvantages and problems of known methods, including as described above.

In yet another aspect, the invention provides a golf stroke training apparatus, as well as methods and systems to train a golfer to improve golf strokes, including putting strokes, wherein the golf stroke training apparatus provides a golf putting stroke surface on which a golfer practices, wherein a golf stroke training apparatus with a golf putting stroke surface on which a golfer practices, wherein the slope of the putting stroke surface is adjustable and which putting stroke surface is a planar surface so that the putting stroke surface can be levelled statically to the supporting frame below it, and wherein the static level can then be adjusted by adding slope and/or pitch in quantifiable measurements, wherein movement of the planar putting stroke surface is performed using a plurality of actuators, such as electric actuators, attached, such as directly attached, to the underside of the planar putting stroke surface, and wherein the plurality of actuators are located at each corner as well as at the middle of the planar putting stroke surface, and wherein the plurality of actuators are coupled with inclinometers and are electronically adjusted with software technology, and wherein scientific instrumentation and/or software technology can be coupled with the putting stroke surface so as to measure, regarding the golfer on the stroke training apparatus, weight distribution, ground force reaction, stroke analysis, ball launch, roll and distance, and wherein another object of the invention the scientific instrumentation and/or software technology can be coupled with the putting stroke surface so as to measure with a high degree of accuracy, and wherein the putting stroke surface is covered with synthetic grass carpeting, for example short-nap carpeting used for putting, or for example deeper-nap carpeting for non-putting golf strokes, and wherein the apparatus provides a standard-sized and standard-depth cup for receiving a golf ball, as used on a golf course, and wherein the placement of said cup provides a measured ten-foot putt, as well as an eighteen-inch overrun behind the cup, and wherein overrun provides assistance in speed of the golf ball delivery into the cup, and wherein the novel apparatus and methods and systems of the invention provides repeatable golf stroke environments ranging from straight-level putts to breaking putts of any degree slope, and wherein the repeatable golf stroke environments provides repeatable and quantifiable golfer actions that permit improved golf stroke consistency and/or golf stroke analysis and/or golf stroke improvement, and which novel apparatus and methods and systems of the invention solved the multiple disadvantages and problems of known methods, including as described above.

In yet another aspect, the invention provides a golf stroke training apparatus, as well as methods and systems to train a golfer to improve golf strokes, including putting strokes, wherein the golf stroke training apparatus provides a golf stroke surface on which a golfer practices, wherein a golf stroke training apparatus with a golf stroke surface on which a golfer practices, wherein the slope of the stroke surface is adjustable and which stroke surface is a planar surface so that the planar stroke surface can be levelled statically to the supporting frame below it, and wherein the static level can then be adjusted by adding slope and/or pitch in quantifiable measurements, wherein movement of the planar stroke surface is performed using a plurality of actuators, such as electric actuators, attached, such as directly attached, to the underside of the planar stroke surface, and wherein the plurality of actuators are located at each corner as well as at the middle of the planar stroke surface, and wherein the plurality of actuators are coupled with inclinometers and are electronically adjusted with software technology, and wherein scientific instrumentation and/or software technology can be coupled with the planar stroke surface so as to measure, regarding the golfer on the stroke training apparatus, weight distribution, ground force reaction, stroke analysis, ball launch, roll and distance, and wherein another object of the invention the scientific instrumentation and/or software technology can be coupled with the planar stroke surface so as to measure with a high degree of accuracy, and wherein the planar stroke surface is covered with synthetic grass carpeting, for example deeper-nap carpeting for golf strokes, and wherein the apparatus optionally provides a standard-sized and standard-depth cup for receiving a golf ball, as used on a golf course, and wherein the novel apparatus and methods and systems of the invention provides repeatable golf stroke environments, for example golf strokes of any degree slope, and wherein the repeatable golf stroke environments provides repeatable and quantifiable golfer actions that permit improved golf stroke consistency and/or golf stroke analysis and/or golf stroke improvement, and which novel apparatus and methods and systems of the invention solved the multiple disadvantages and problems of known methods, including as described above.

In yet other aspects, the invention provides a golf stroke training apparatus, as well as methods and systems to train a golfer to improve golf strokes, including putting strokes, wherein the golf stroke training apparatus, as disclosed herein in the specification, examples, drawings, and claims, provides unexpected and positive results in contrast to, and thereby solving, one or more of the multiple disadvantages and problems of known methods as described above, as readily recognized and understood by one of ordinary skill in the art based upon this disclosure.

In yet other aspects, the invention provides a golf stroke training apparatus, as well as methods and systems to train a golfer to improve golf strokes, including putting strokes, wherein the golf stroke training apparatus, as disclosed herein in the specification, examples, drawings, and claims, provides unexpected and positive results in contrast to and thereby solving one or more of the multiple disadvantages and problems of known methods as described herein, as readily recognized and understood by one of ordinary skill in the art based upon this disclosure, including providing a golf stroke surface on which to practice, wherein the adjustable slope of the stroke surface provides the golfer, inter alia, the feel of the slope, the sight and view of the slope, and an understanding in the changes in slope, thereby solving, one or more of the multiple disadvantages and problems of known methods as described above.

BRIEF DESCRIPTION OF THE DRAWINGS

The detailed description and exemplary embodiments may refer to the accompanying drawings and figures, which are disclosed as examples and not intended to be limiting, and in which other characteristics and advantages of the invention are recognized and understood by one of ordinary skill in the art. Further objects, features, aspects and advantages of the embodiments of this disclosure become apparent to and recognized and understood by one of ordinary skill in the art upon reference to the drawings and the detailed description herein including the claims.

Note that the disclosure herein will readily be recognized and understood by one of ordinary skill in the art to have broad usefulness and application, and multiple advantages and improvements and benefits over the known golf stroke training apparatuses and methods, and while some embodiments are disclosed for illustrative purposes in providing a full and enabling disclosure of the present invention, some embodiments, such as adaptations, variations, modifications, and equivalent arrangements, are implicitly disclosed by the embodiments described herein and fall within the scope of the invention. Accordingly, the disclosure herein is illustrative and exemplary of the invention, and is made for the purposes of providing a full and enabling disclosure of the invention.

DETAILED DESCRIPTION

Figure 1:
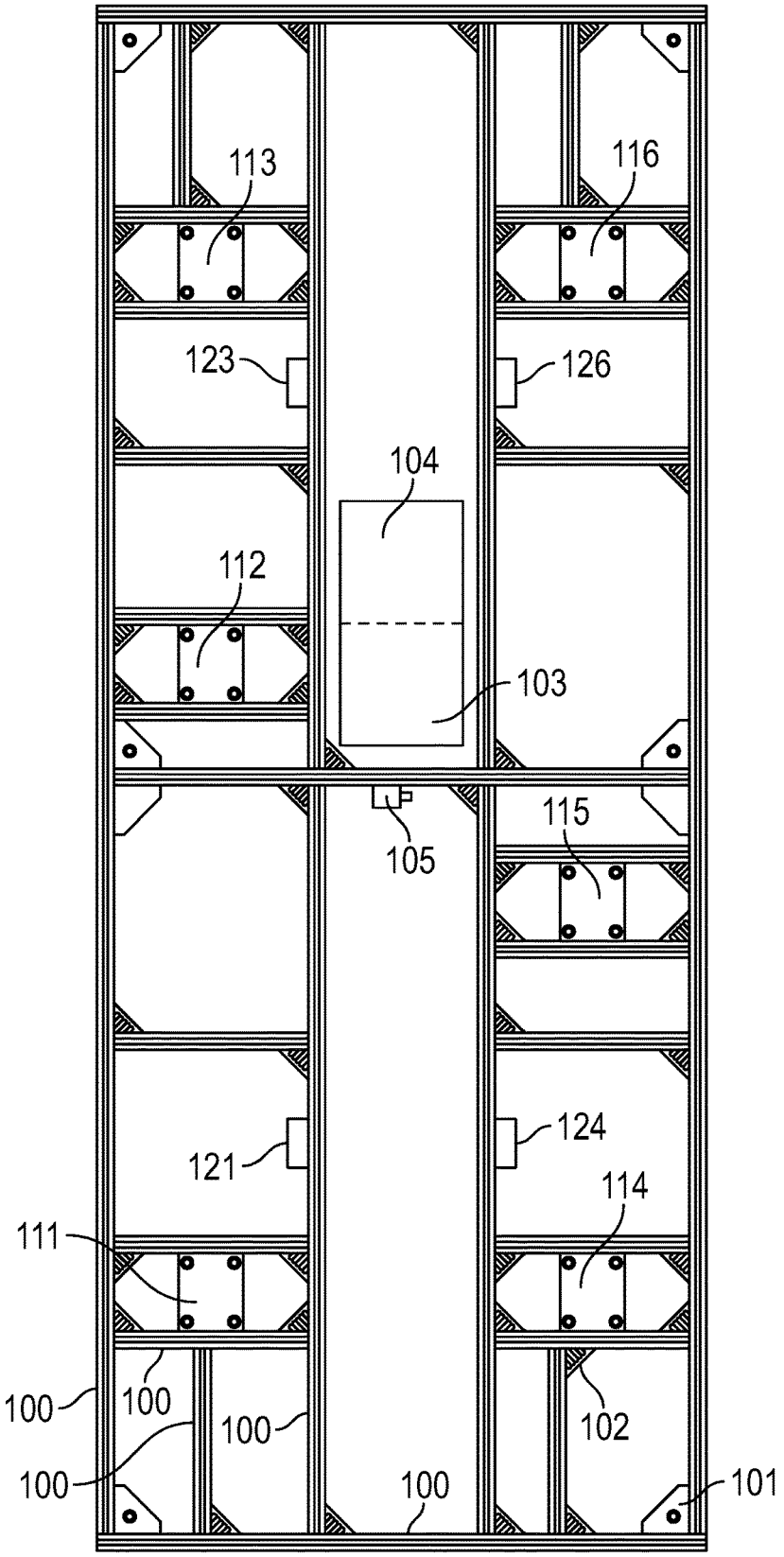
FIG. 1 is an exemplary illustration of a top view of the invention in accordance with an embodiment of the invention regarding a golf stroke training apparatus, as well as methods and systems to train a golfer to improve golf strokes, including putting strokes, wherein the golf stroke training apparatus provides a supporting frame for the planar golf putting stroke surface, and here showing the placement of the actuators, that is motors, the junction boxes, the inclinometer, that is levelling sensor, the control box, the power supply, the framework, corner plates, gussets, wherein each component is attached to the bottom of the planar surface, that is, putting platform that is attached to the supporting frame, and wherein is shown the supporting frame configuration and location of corners plates, gussets, extruded aluminum bracing, and actuator mounting brackets, wherein is shown that the embodiment provides stability and takes into account all the weight positions of the golfer while minimizing flection of the putting surface connected above the supporting frame, that is putting platform, that is deck, and thereby providing and maintaining a planar putting stroke surface.
Figure 2:
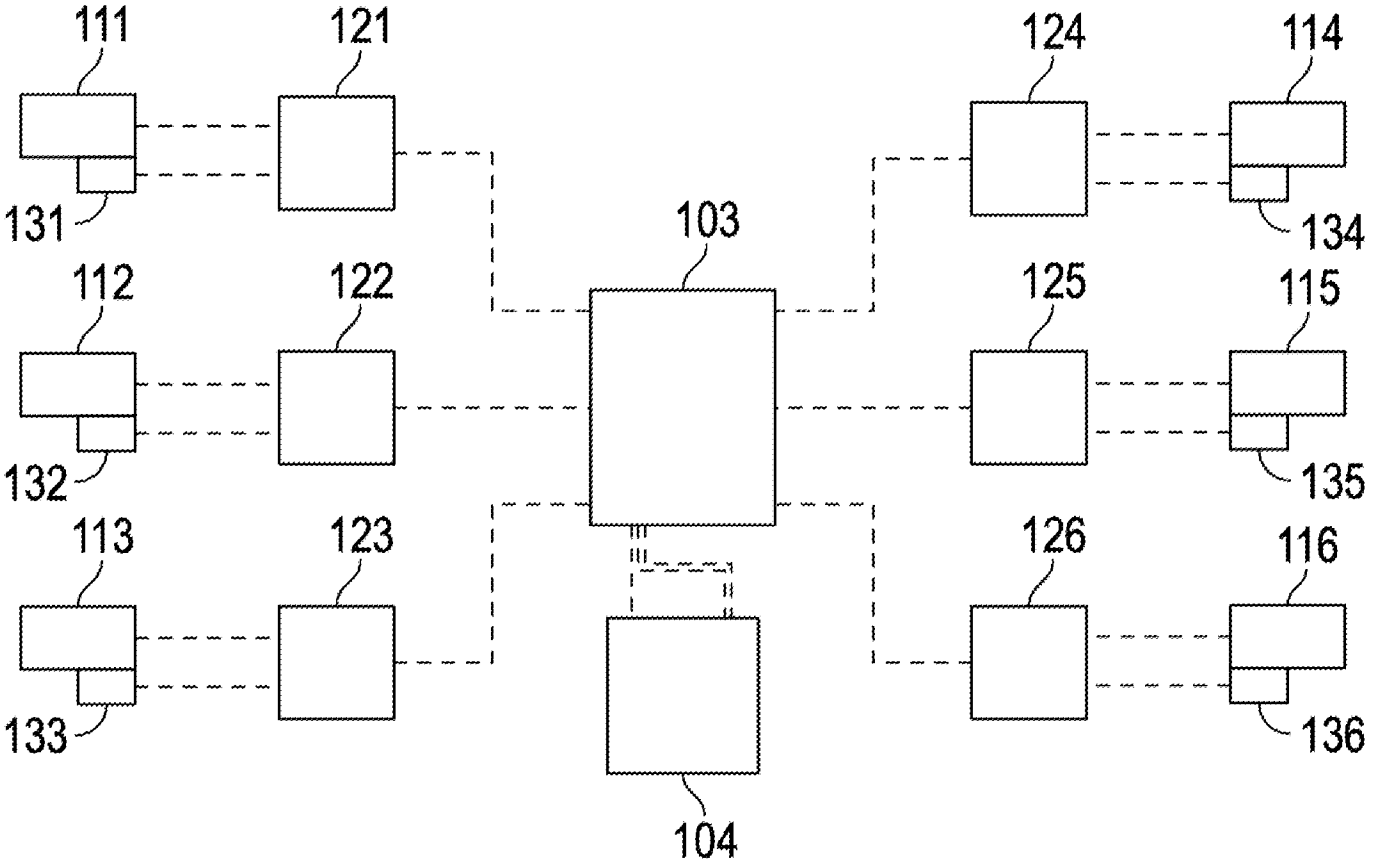
FIG. 2 is an exemplary illustration of a layout view of the invention in accordance with an embodiment of the invention regarding a golf stroke training apparatus, as well as methods and systems to train a golfer to improve golf strokes, including putting strokes, wherein is shown the actuators, that is motors, junction boxes, control box, and power supply as viewed from the bottom of the planar putting stroke surface, that is putting platform, and wherein is shown how these components, in accordance with an embodiment of the invention, are attached to the bottom of the putting platform, and wherein is shown an electric version that fully automates the planar putting platform.

Embodiments of the invention are described in detail below and the features and/or aspects and/or elements described in detail with respect to certain illustrative example embodiments may be combined and sub-combined in and/or with various other example embodiments as recognized and understood by one of ordinary skill in the art. Some embodiments, whether individually and/or collectively, may be components of a larger system, wherein other steps may take precedence over and/or otherwise modify their application as recognized and understood by one of ordinary skill in the art. This detailed description discloses objects, features, aspects and advantages of the embodiments of this disclosure as are readily recognized and understood by one of ordinary skill in the art, and discloses unexpected and positive results with regard to golf stroke training and golf putting stroke training, and which is in contrast to and thereby solving one or more of the multiple disadvantages and problems of known methods as described herein.

The terminology used herein for describing particular illustrative example embodiments, is not intended to be limiting of the invention. Thus, as used herein, the singular forms "a" and "an" and "the" are intended to include the plural forms as well, unless the context clearly indicates otherwise. The terms "comprises" and "includes" and "comprising" and "including" when used in this specification, specify the presence of stated features, integers, steps, operations, elements, and/or components, but do not preclude the presence and/or addition of one or more other features, integers, steps, operations, elements, components, and/or groups thereof. The term "or" is intended to mean an inclusive "or" rather than an exclusive "or", that is, unless specified otherwise, or clear from context, so that "X employs A or B" is intended to mean any of the natural inclusive permutations, namely, if X employs A; X employs B; or X employs both A and B, then "X employs A or B" is satisfied under any of the foregoing instances. Unless otherwise defined, all terms used herein, including technical and scientific terms, have the same meaning as recognized and understood by one of ordinary skill in the art in the art to which this disclosure belongs. Terms, such as those defined in commonly used dictionaries, should be interpreted as having a meaning that is consistent with their meaning in the context of the relevant art and should not be interpreted in an idealized and/or overly-formal sense unless expressly so defined herein. Terms may have meaning consistent with their meaning in the context of the relevant art to which this disclosure pertains as well as additional and clarifying meaning and nuance given to them as defined herein. Note that although terms "first" and "second" and similar ordinal numbers can be used herein to describe various steps and/or parts of methods and/or systems, these terms are not intended necessarily be limiting, rather these terms are used to distinguish certain steps and/or parts of methods and/or systems from certain others, and therefore, a first step, part or section discussed below could be termed a second step, part or section without departing from various teachings of this disclosure. Relative terms that are herein to describe the invention can be used to describe relationships such as disclosed herein, and are intended to encompass not only the relationships described herein and/or as depicted in the accompanying illustrative exemplary drawings, but also different relationships evident to and recognized and understood by one of ordinary skill in the art upon reading this disclosure. Terms listed below, as recognized and understood by one of ordinary skill in the art, are further defined for additional clarity.

The term golf stroke or golf strokes, as recognized and understood by one of ordinary skill in the art, also includes meaning, as appropriate given the context of the usage, for example, but not limited to putting strokes and swings and wedge strokes. The term planar golf stroke surface, as recognized and understood by one of ordinary skill in the art, also includes meaning, as appropriate given the context of the usage, for example, but not limited to a planar surface or a planar platform, for golf strokes or golf putting strokes.

The multiple embodiments of the invention, as described herein in the specification, drawings, examples and claims, disclose a novel golf stroke training apparatus, as well as methods and systems to train a golfer to improve golf strokes, including putting strokes, wherein the golf stroke training apparatus provides a golf putting stroke surface 300 on which a golfer practices, wherein a golf stroke training apparatus with a golf putting stroke surface 300 on which a golfer practices, wherein the slope of the putting stroke surface 300 is adjustable and which putting stroke surface 300 is a planar surface so that the putting stroke surface 300 can be levelled statically to the surface below it, and wherein the static level can then be adjusted by adding slope and/or pitch in quantifiable measurements, wherein movement of the planar putting stroke surface 300 is performed using a plurality of actuators 131-136, such as electric actuators, attached, such as directly attached, to the underside of the planar putting stroke surface 300, and wherein the plurality of actuators 131-136 are located at each corner as well as at the middle of the planar putting stroke surface 300, and wherein the plurality of actuators 131-136 are coupled with inclinometers 105 and are electronically adjusted with software technology, and wherein scientific instrumentation and/or software technology can be coupled with the putting stroke surface 300 so as to measure, regarding the golfer on the stroke training apparatus, weight distribution, ground force reaction, stroke analysis, ball launch, roll and distance, and wherein another object of the invention the scientific instrumentation and/or software technology can be coupled with the putting stroke surface 300 so as to measure with a high degree of accuracy, and which novel apparatus and methods and systems of the invention solved the multiple disadvantages and problems of known methods, including as described above.

In embodiments of the invention, multiple advantages are readily recognized and understood by one of ordinary skill in the art based upon this disclosure, and embodiments of the invention provide solutions to the multiple disadvantages and problems of known methods as described herein.

In an embodiment of the invention, a golf stroke training apparatus, as well as methods and systems to train a golfer to improve golf strokes, including putting strokes, provide improvements, wherein improvements include, inter alia, an increase in consistency and repeatability of the putting strokes, thereby solving the multiple disadvantages and problems of known methods, including as described above.

In another embodiment of the invention, a golf stroke training apparatus, as well as methods and systems to train a golfer to improve golf strokes, including putting strokes, provides a golf putting stroke surface 300 on which a golfer practices, wherein the slope of the putting stroke surface 300 is adjustable, and which putting stroke surface 300 is a planar surface such that the putting stroke surface 300 can be levelled statically to the supporting frame 100 below the putting stroke surface 300, thereby solving the multiple disadvantages and problems of known methods, including as described above.

In yet another embodiment of the invention, a golf stroke training apparatus, as well as methods and systems to train a golfer to improve golf strokes, including putting strokes, provides a golf putting stroke surface 300 on which a golfer practices, wherein the slope of the putting stroke surface 300 is adjustable and which putting stroke surface 300 is a planar surface so that the putting stroke surface 300 can be levelled statically to the supporting frame 100 below it, and wherein the static level can then be adjusted by adding slope and/or pitch in quantifiable measurements, and in another object of the invention, adjusting in quantifiable measurements to less than about one-tenth of a degree or about 0.3 percent of slope, thereby solving the multiple disadvantages and problems of known methods, including as described above.

In yet another embodiment of the invention, a golf stroke training apparatus, as well as methods and systems to train a golfer to improve golf strokes, including putting strokes, provides golf stroke training apparatus with a golf putting stroke surface 300 on which a golfer practices, wherein the slope of the putting stroke surface 300 is adjustable and which putting stroke surface 300 is a planar surface so that the putting stroke surface 300 can be levelled statically to the supporting frame 100 below it, and wherein the static level can then be adjusted by adding slope and/or pitch in quantifiable measurements, wherein scientific instrumentation and/or software technology can be coupled with the putting stroke surface 300 so as to measure, regarding the golfer on the stroke training apparatus, weight distribution, ground force reaction, stroke analysis, ball launch, roll and distance, and wherein another object of the invention the scientific instrumentation and/or software technology can be coupled with the putting stroke surface 300 so as to measure with a high degree of accuracy, thereby solving the multiple disadvantages and problems of known methods, including as described above.

In yet another embodiment of the invention, a golf stroke training apparatus, as well as methods and systems to train a golfer to improve golf strokes, including putting strokes, provides a golf stroke training apparatus with a golf putting stroke surface 300 on which a golfer practices, wherein the slope of the putting stroke surface 300 is adjustable and which putting stroke surface 300 is a planar surface so that the putting stroke surface 300 can be levelled statically to the supporting frame 100 below it, and wherein the static level can then be adjusted by adding slope and/or pitch in quantifiable measurements, wherein movement of the planar putting stroke surface 300 is performed using a plurality of actuators 131-136, such as electric actuators, attached, such as directly attached, to the underside of the planar putting stroke surface 300, and wherein the plurality of actuators 131-136 are located at each corner as well as at the middle of the planar putting stroke surface 300, and wherein the plurality of actuators 131-136 are coupled with inclinometers 105 and are electronically adjusted with software technology, and wherein scientific instrumentation and/or software technology can be coupled with the putting stroke surface 300 so as to measure, regarding the golfer on the stroke training apparatus, weight distribution, ground force reaction, stroke analysis, ball launch, roll and distance, and wherein another object of the invention the scientific instrumentation and/or software technology can be coupled with the putting stroke surface 300 so as to measure with a high degree of accuracy, thereby solving the multiple disadvantages and problems of known methods, including as described above.

In yet another embodiment of the invention, a golf stroke training apparatus, as well as methods and systems to train a golfer to improve golf strokes, including putting strokes, provides a golf stroke training apparatus with a golf putting stroke surface 300 on which a golfer practices, wherein the slope of the putting stroke surface 300 is adjustable and which putting stroke surface 300 is a planar surface 300 so that the putting stroke surface 300 can be levelled statically to the supporting frame 100 below it, and wherein the static level can then be adjusted by adding slope and/or pitch in quantifiable measurements, wherein movement of the planar putting stroke surface 300 is performed using a plurality of actuators 131-136, such as electric actuators, attached, such as directly attached, to the underside of the planar putting stroke surface 300, and wherein the plurality of actuators 131-136 are located at each corner as well as at the middle of the planar putting stroke surface 300, and wherein the plurality of actuators 131-136 are coupled with inclinometers 105 and are electronically adjusted with software technology, and wherein scientific instrumentation and/or software technology can be coupled with the putting stroke surface 300 so as to measure, regarding the golfer on the stroke training apparatus, weight distribution, ground force reaction, stroke analysis, ball launch, roll and distance, and wherein another object of the invention the scientific instrumentation and/or software technology can be coupled with the putting stroke surface 300 so as to measure with a high degree of accuracy, and wherein the putting stroke surface 300 is covered with synthetic grass carpeting 330, for example short-nap carpeting used for putting, or for example deeper-nap carpeting for non-putting golf strokes, and wherein the apparatus provides a standard-sized and standard-depth cup 350 for receiving a golf ball, as used on a golf course, and wherein the placement of cup 350 provides a measured ten-foot putt, as well as an eighteen-inch overrun behind cup 350, and wherein overrun provides assistance in speed of the golf ball delivery into cup 350, thereby solving the multiple disadvantages and problems of known methods, including as described above.

In yet another embodiment of the invention, a golf stroke training apparatus, as well as methods and systems to train a golfer to improve golf strokes, including putting strokes, provides a golf stroke training apparatus with a golf putting stroke surface 300 on which a golfer practices, wherein the slope of the putting stroke surface 300 is adjustable and which putting stroke surface 300 is a planar surface so that the putting stroke surface 300 can be levelled statically to the supporting frame 100 below it, and wherein the static level can then be adjusted by adding slope and/or pitch in quantifiable measurements, wherein movement of the planar putting stroke surface 300 is performed using a plurality of actuators 131-136, such as electric actuators, attached, such as directly attached, to the underside of the planar putting stroke surface 300, and wherein the plurality of actuators 131-136 are located at each corner as well as at the middle of the planar putting stroke surface 300, and wherein the plurality of actuators 131-136 are coupled with inclinometers 105 and are electronically adjusted with software technology, and wherein scientific instrumentation and/or software technology can be coupled with the putting stroke surface 300 so as to measure, regarding the golfer on the stroke training apparatus, weight distribution, ground force reaction, stroke analysis, ball launch, roll and distance, and wherein another object of the invention the scientific instrumentation and/or software technology can be coupled with the putting stroke surface 300 so as to measure with a high degree of accuracy, and wherein the putting stroke surface 300 is covered with synthetic grass carpeting 330, for example short-nap carpeting used for putting, or for example deeper-nap carpeting for non-putting golf strokes, and wherein the apparatus provides a standard-sized and standard-depth cup 350 for receiving a golf ball, as used on a golf course, and wherein the placement of cup 350 provides a measured ten-foot putt, as well as an eighteen-inch overrun behind cup 350, and wherein overrun provides assistance in speed of the golf ball delivery into cup 350, and wherein the novel apparatus and methods and systems of the invention provides repeatable golf stroke environments ranging from straight-level putts to breaking putts of any degree slope, and wherein the repeatable golf stroke environments provides repeatable and quantifiable golfer actions that permit improved golf stroke consistency and/or golf stroke analysis and/or golf stroke improvement, thereby solving the multiple disadvantages and problems of known methods, including as described above.

In yet another embodiment of the invention, a golf stroke training apparatus, as well as methods and systems to train a golfer to improve golf strokes, including putting strokes, provides a golf stroke training apparatus with a golf putting stroke surface 300 on which a golfer practices, wherein slope of the stroke surface 300 is adjustable and which stroke surface 300 is a planar surface so that the planar stroke surface 300 can be levelled statically to the supporting frame 100 below it, and wherein the static level can then be adjusted by adding slope and/or pitch in quantifiable measurements, wherein movement of the planar stroke surface 300 is performed using a plurality of actuators 131-136, such as electric actuators, attached, such as directly attached, to the underside of the planar stroke surface 300, and wherein the plurality of actuators 131-136 are located at each corner as well as at the middle of the planar stroke surface 300, and wherein the plurality of actuators 131-136 are coupled with inclinometers 105 and are electronically adjusted with software technology, and wherein scientific instrumentation and/or software technology can be coupled with the planar stroke surface 300 so as to measure, regarding the golfer on the stroke training apparatus, weight distribution, ground force reaction, stroke analysis, ball launch, roll and distance, and wherein another object of the invention the scientific instrumentation and/or software technology can be coupled with the planar stroke surface 300 so as to measure with a high degree of accuracy, and wherein the planar stroke surface 300 is covered with synthetic grass carpeting 330, for example deeper-nap carpeting for golf strokes, and wherein the apparatus optionally provides a standard-sized and standard-depth cup 350 for receiving a golf ball, as used on a golf course, and wherein the novel apparatus and methods and systems of the invention provides repeatable golf stroke environments, for example golf strokes of any degree slope, and wherein the repeatable golf stroke environments provides repeatable and quantifiable golfer actions that permit improved golf stroke consistency and/or golf stroke analysis and/or golf stroke improvement, thereby solving the multiple disadvantages and problems of known methods, including as described above.

In yet other embodiments of the invention, providing a golf stroke training apparatus, as well as methods and systems to train a golfer to improve golf strokes, including putting strokes, as disclosed herein in the specification, examples, drawings, and claims, provides unexpected and positive results in contrast to, and thereby solves, one or more of the multiple disadvantages and problems of known methods as described above, as readily recognized and understood by one of ordinary skill in the art based upon this disclosure.

In yet other embodiments of the invention, the invention provides a golf stroke training apparatus, as well as methods and systems to train a golfer to improve golf strokes, including putting strokes, wherein the golf stroke training apparatus, as disclosed herein in the specification, examples, drawings, and claims, provides unexpected and positive results in contrast to and thereby solving one or more of the multiple disadvantages and problems of known methods as described herein, as readily recognized and understood by one of ordinary skill in the art based upon this disclosure, including providing a golf stroke surface 300 on which to practice, wherein the adjustable slope of the stroke surface 300 provides the golfer, inter alia, the feel of the slope, the sight and view of the slope, and an understanding in the changes in slope, thereby solving, one or more of the multiple disadvantages and problems of known methods as described above.

In yet other embodiments of the invention, the invention provides a golf stroke training apparatus, as well as methods and systems to train a golfer to improve golf strokes, including putting strokes, wherein the golf stroke training apparatus, as disclosed herein in the specification, examples, drawings, and claims, provides, and thereby solves multiple disadvantages and problems of known methods as described herein, in that the invention provides that the slope of the putting stroke surface 300 is adjustable and which putting stroke surface 300 is a planar surface so that the putting stroke surface 300 can be levelled statically to the supporting frame 100 below it, and wherein the static level can then be adjusted by adding slope and/or pitch in quantifiable measurements, and wherein scientific instrumentation and/or software technology can be coupled with the putting stroke surface 300 so as to measure, regarding the golfer on the stroke training apparatus, weight distribution, ground force reaction, stroke analysis, ball launch, roll and distance, and wherein another object of the invention the scientific instrumentation and/or software technology can be coupled with the putting stroke surface 300 so as to measure with a high degree of accuracy, and wherein the scientific instrumentation and/or software technology is operably connected, either via a wired or wireless connection, to the planar putting platform, and thereby utilizing such software technology a golfer and/or user and/or trainer is capable of moving the platform via the actuators 131-136, that is motors, as described herein, and is further capable of being calibrated, including controls for changing roll, pitch, left right slope and up or down positioning, and also including controls for movements of each single motor 131-136, that is the six motors 131-136 at each corner of the platform as well as in the middle side of the platform, and also including controls for providing a zero pitch and zero roll putting platform state, also including controls for moving the platform to a static level or to fully retract all motors 131-136, wherein each motor 131-136 has a plurality of icons in the software to indicate its state, and also including controls for saving these parameters in a golfer and/or trainer and/or user profile in the software.

In yet other embodiments of the invention, the invention provides a golf stroke training apparatus, as well as methods and systems to train a golfer to improve golf strokes, including putting strokes, wherein the golf stroke training apparatus, as disclosed herein in the specification, examples, drawings, and claims, provides, and thereby solves multiple disadvantages and problems of known methods as described herein, in that the invention provides that the top planar putting surface 300, that is putting platform, is supported, as described herein and in the drawings, by a frame 100 which provides support and rigidity.

In yet other embodiments of the invention, the invention provides a golf stroke training apparatus, as well as methods and systems to train a golfer to improve golf strokes, including putting strokes, wherein the golf stroke training apparatus, as disclosed herein in the specification, examples, drawings, and claims, provides, and thereby solves multiple disadvantages and problems of known methods as described herein, in that the invention provides a golf stroke training apparatus that permits a golfer a practice chosen strokes, such as putting strokes, repeatedly in order to gain mastery of said strokes, and to do so in a wide range of golf stroke environments created by the positioning of the golf stroke training apparatus, that is by multiple configurations of the putting platform, and to do so by being able to recreate those golf stroke environments so created by saving the configurations using software technology, and to provide analysis of the golfer's performance in all golf stroke environments and to provide analysis of the same, in order to improve the golfer's skill at golf strokes, including putting strokes, and increase the golfer's consistency and/or accuracy, wherein the repeatable golf stroke environments and golf putting stroke environments, provide repeatable and quantifiable golfer actions and practice that result in improvement of the golfer's stroke ability, and which novel apparatus and methods and systems of the invention solved the multiple disadvantages and problems of known methods, including as described above.

Shown in FIG. 1 is an embodiment of the invention wherein the golf stroke training apparatus provides a supporting frame 100 for the planar golf putting stroke surface 300, actuators 131-136, that is motors, junction boxes 121-126, inclinometer 105, that is levelling sensor, control box 103, power supply 104, framework, corner plates 101, and gussets 102, wherein each component is attached to the bottom of the planar surface 300, that is, putting platform that is attached to the supporting frame 100. The embodiment provides stability and takes into account all the weight positions of the golfer while minimizing flection of the putting surface connected above the supporting frame 100, thereby providing and maintaining a planar putting stroke surface.

Figure 3:
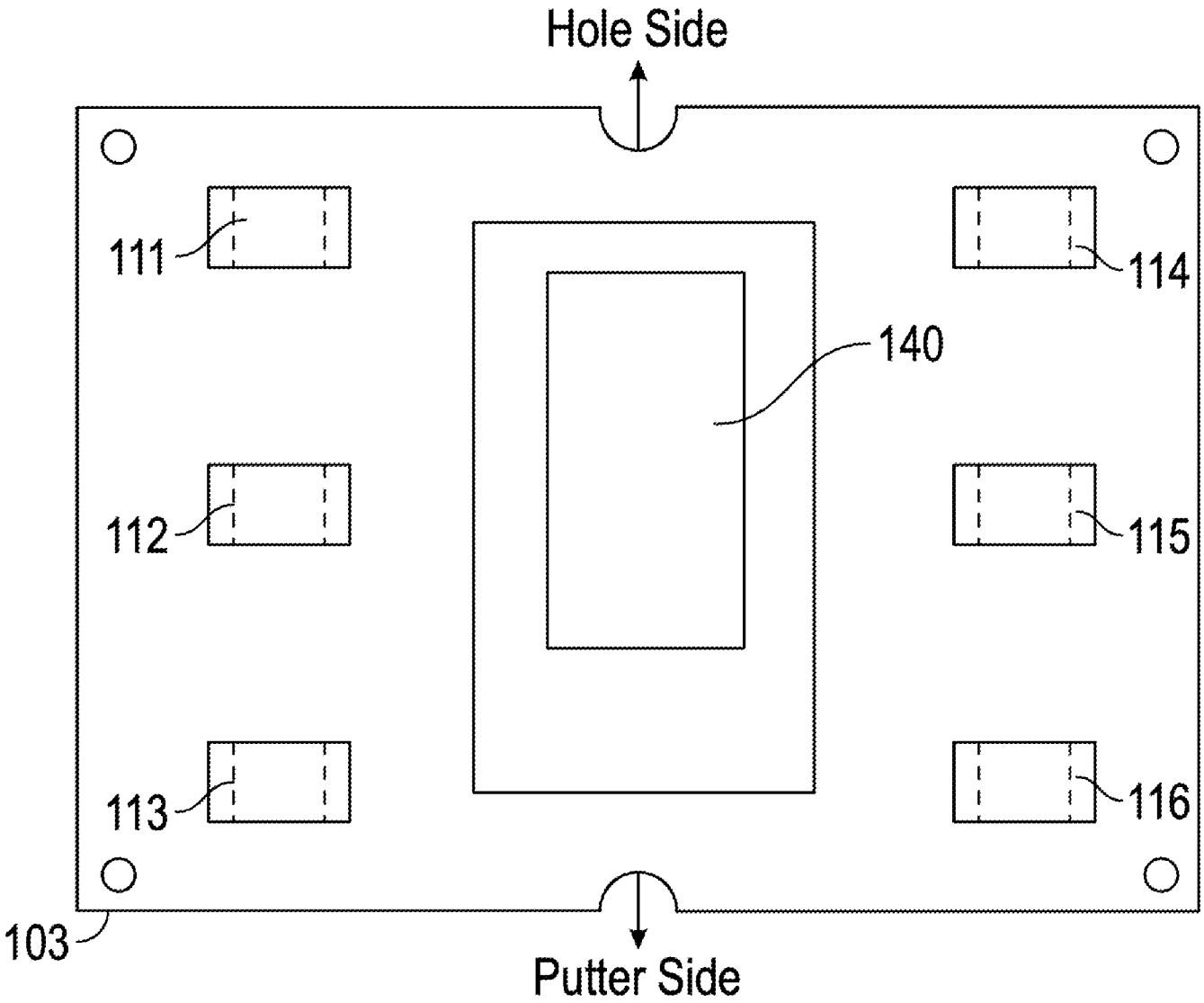
FIG. 3 is an exemplary illustration of a view of the invention in accordance with an embodiment of the invention regarding a golf stroke training apparatus, as well as methods and systems to train a golfer to improve golf strokes, including putting strokes, wherein is an arduino board (central) and motor drivers around the arduino board, such that each motor driver works with a specific actuator, that is motor, and wherein is shown the motor driver attached to the arduino board located inside the control box, and wherein is shown that the embodiment provides information received from the inclinometer and such information is sent to individual actuators to permit an exact positioning of the putting platform in real time.

Shown in FIG. 3 is an embodiment of the invention having motor drivers 111-116 around the arduino board 140, such that each motor driver 111-116 works with a specific actuator 131-136, that is motor, wherein motor driver 111-116 is attached to arduino board 140 located inside control box 103, and wherein information received from the inclinometer 105 is sent to individual actuators 131-136 to permit an exact positioning of the putting platform in real time.

In an embodiment, the apparatus may have a plurality of feet 320 and 321.

Figure 4:
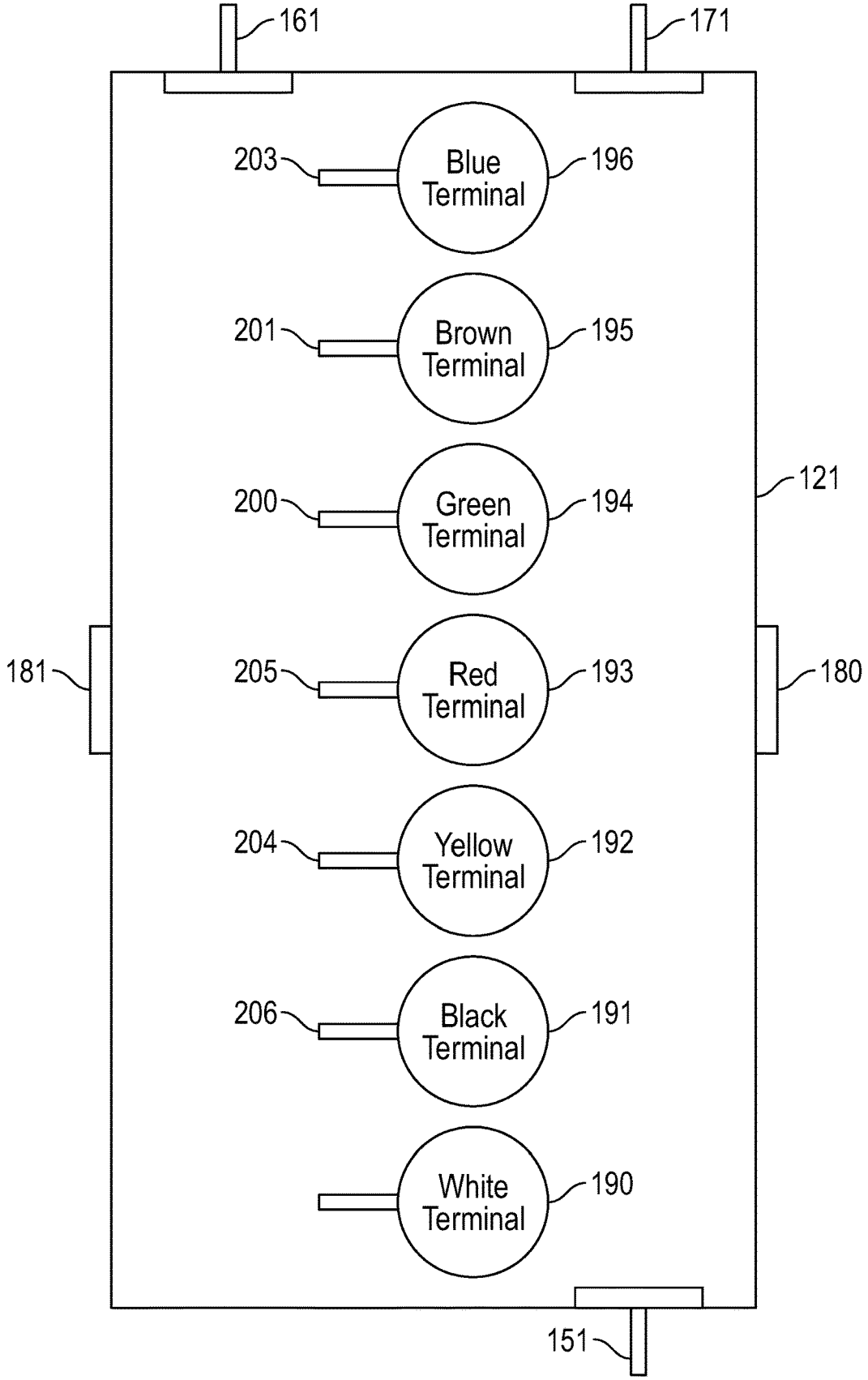
FIG. 4 is an exemplary illustration of a view of the invention in accordance with an embodiment of the invention regarding a golf stroke training apparatus, as well as methods and systems to train a golfer to improve golf strokes, including putting strokes, wherein is shown in particular the wiring layout in the junction boxes, wherein the junction boxes are located in between the individual actuators, that is motors, and the control box, and wherein is shown a fuse box location, and wherein the embodiment provides the control box to send and receive signals from the actuators that have internal limiter switches, not shown, that monitor full extend, full retract, and a ground contact sensor to permit determination that the actuators are on the ground.
Figure 5:
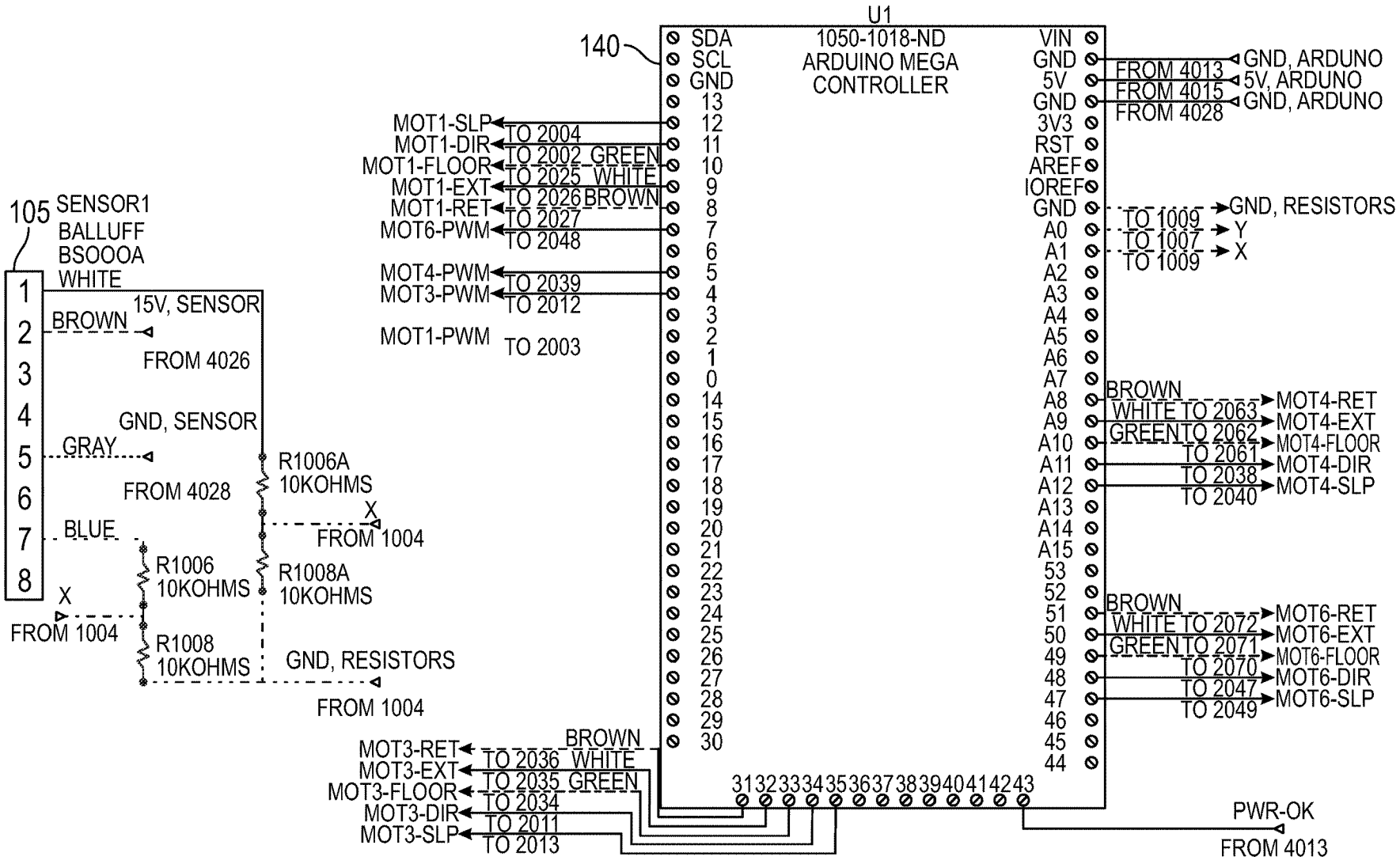
FIG. 5 is an exemplary illustration of a view of the invention in accordance with an embodiment of the invention regarding a golf stroke training apparatus, as well as methods and systems to train a golfer to improve golf strokes, including putting strokes, wherein is shown in particular the arduino board configuration, wherein is shown the arduino board as the point of contact for wiring for the control boxes, and wherein is shown that the embodiment provides technology, such as software and firmware, to communicate and interact with individual actuators, and wherein is shown that the embodiment provides putting platform and connected supporting frame movements to specific and exact locations.
Figure 6:
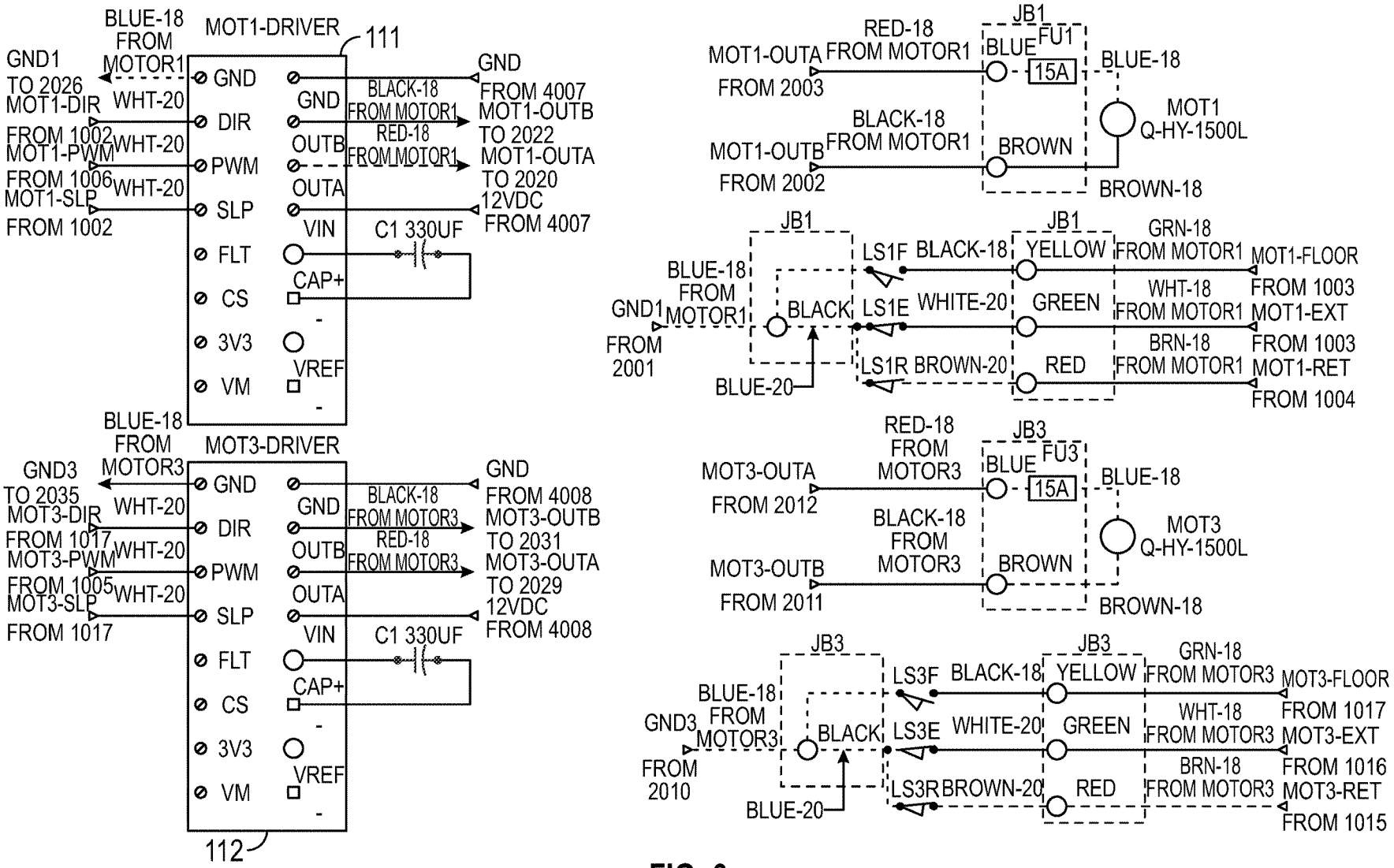
FIG. 6 is an exemplary illustration of a view of the invention in accordance with an embodiment of the invention regarding a golf stroke training apparatus, as well as methods and systems to train a golfer to improve golf strokes, including putting strokes, wherein is shown in particular wiring configuration for motor 1 and motor 3 that are located on the right side of the putting platform as one looks towards the ball cup side, that is the hole side, as shown in FIG. 1, and wherein is shown the wiring schematic between individual motor drivers and the junction box for the two motors, thereby showing completion of the communication process from the control box, not shown, to the junction boxes on each actuator, not shown, thereby permitting communication with each actuator at an exact level.
Figure 7:
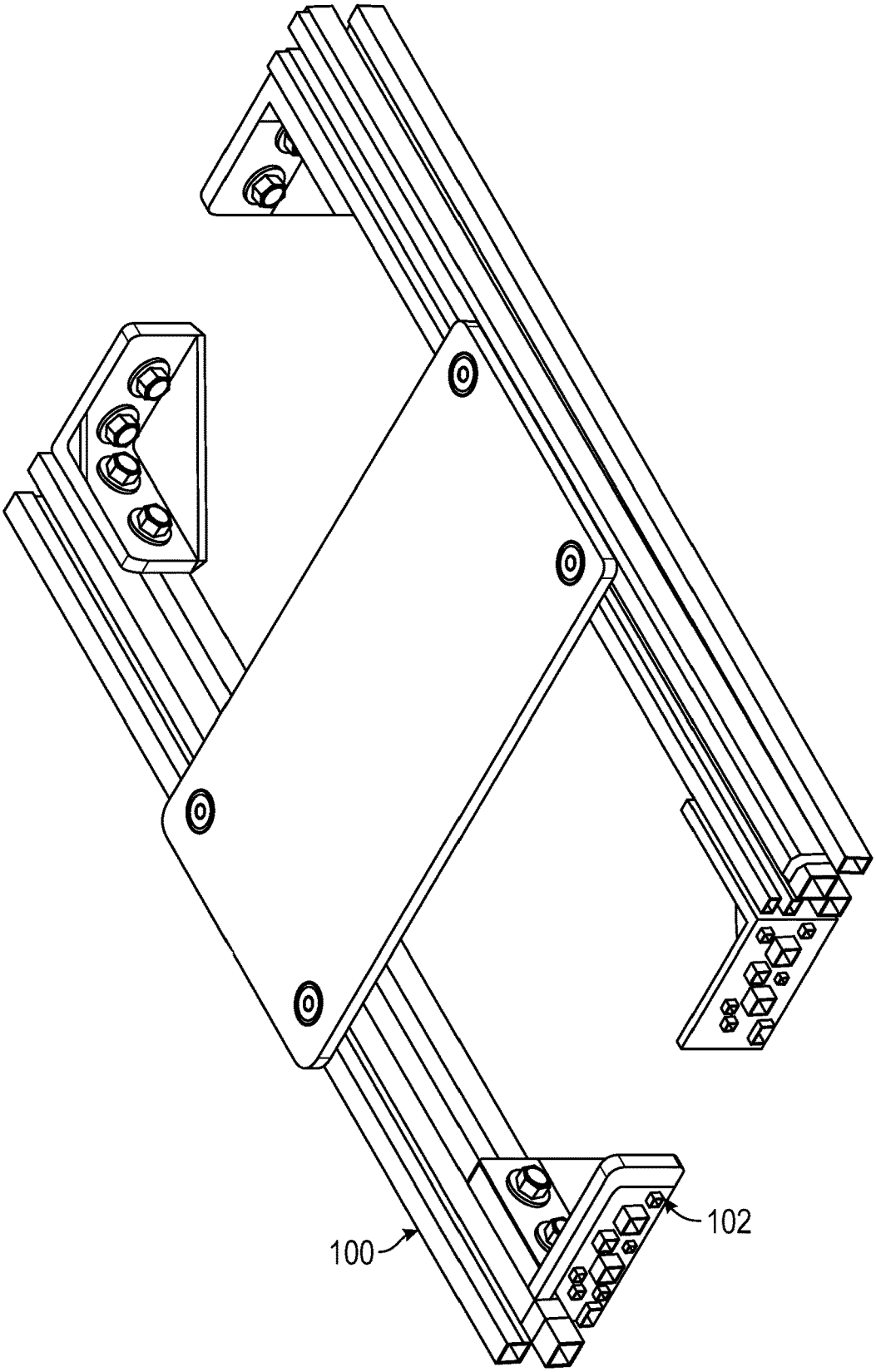
FIG. 7 is an exemplary illustration of an isometric view of the invention in accordance with an embodiment of the invention regarding a golf stroke training apparatus, as well as methods and systems to train a golfer to improve golf strokes, including putting strokes, wherein the golf stroke training apparatus is shown and in particular the supporting frame.
Figure 8:
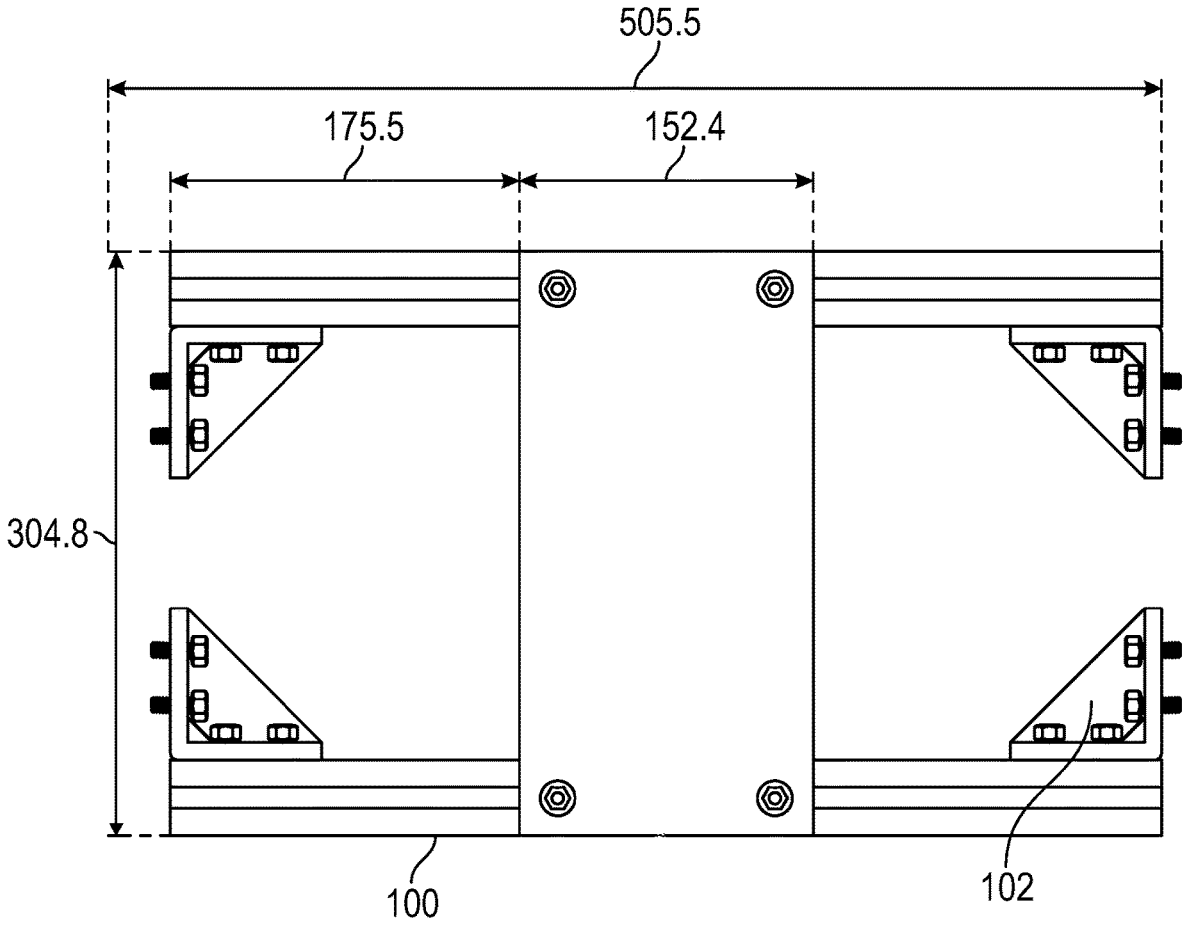
FIG. 8 is an exemplary illustration of a view of the invention in accordance with an embodiment of the invention regarding a golf stroke training apparatus, as well as methods and systems to train a golfer to improve golf strokes, including putting strokes, wherein is shown in particular the supporting frame with indicated dimensions.
Figure 9:
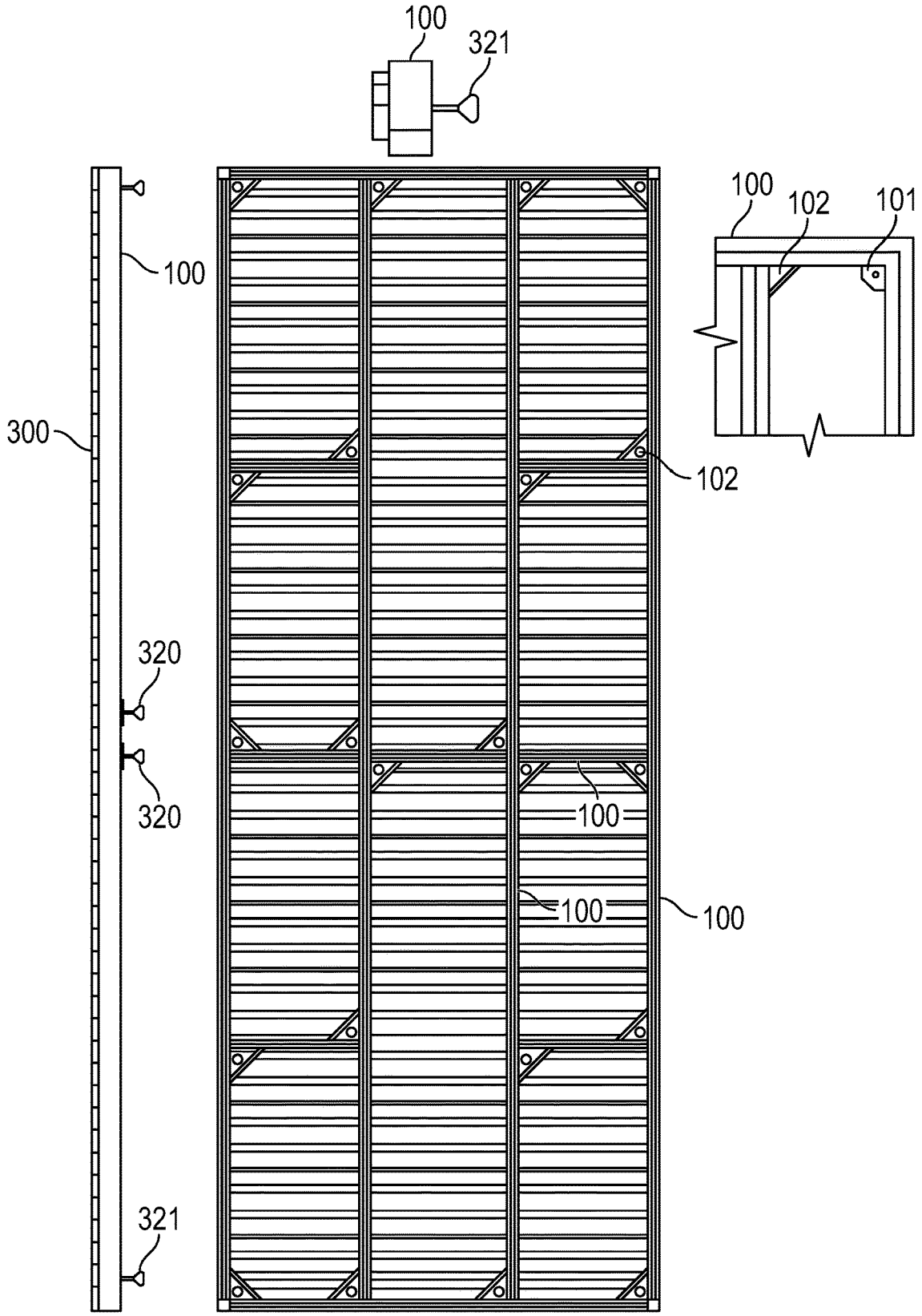
FIG. 9 is an exemplary illustration of four views of the invention in accordance with an embodiment of the invention regarding a golf stroke training apparatus, as well as methods and systems to train a golfer to improve golf strokes, including putting strokes, wherein is shown in particular the golf stroke training apparatus supporting frame from below with the underside of the planar surface shown, and a side view of the golf stroke training apparatus, and a close-up view of a corner foot of the golf stroke training apparatus, and a close-up of a portion of the golf stroke training apparatus supporting frame.
Figure 10:
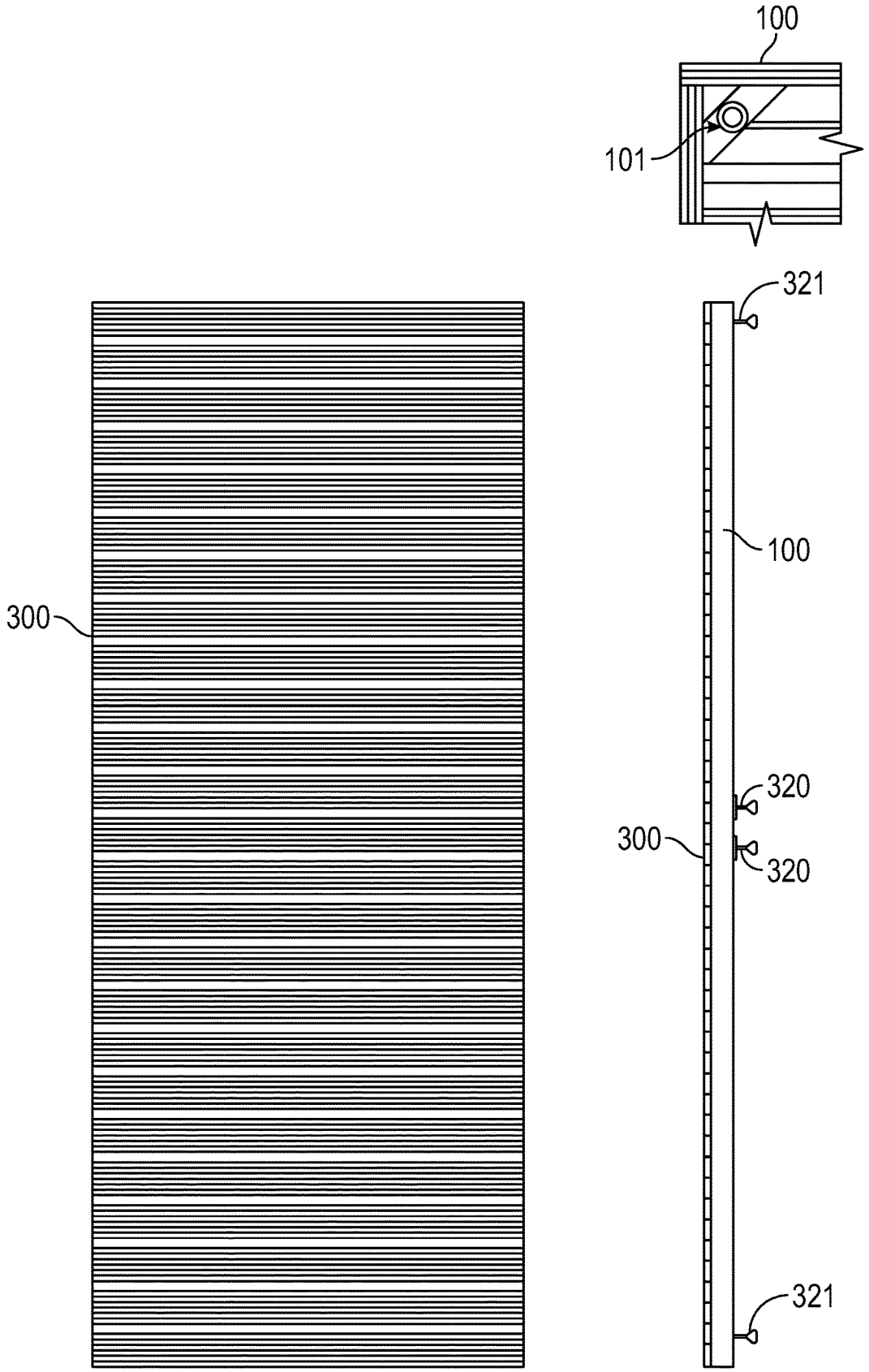
FIG. 10 is an exemplary illustration of three views of the invention in accordance with an embodiment of the invention regarding a golf stroke training apparatus, as well as methods and systems to train a golfer to improve golf strokes, including putting strokes, wherein is shown in particular the golf stroke training apparatus from above with the top of the planar surface shown, and a side view of the golf stroke training apparatus, and a close-up view of a portion of a corner of the golf stroke training apparatus.
Figure 11A:
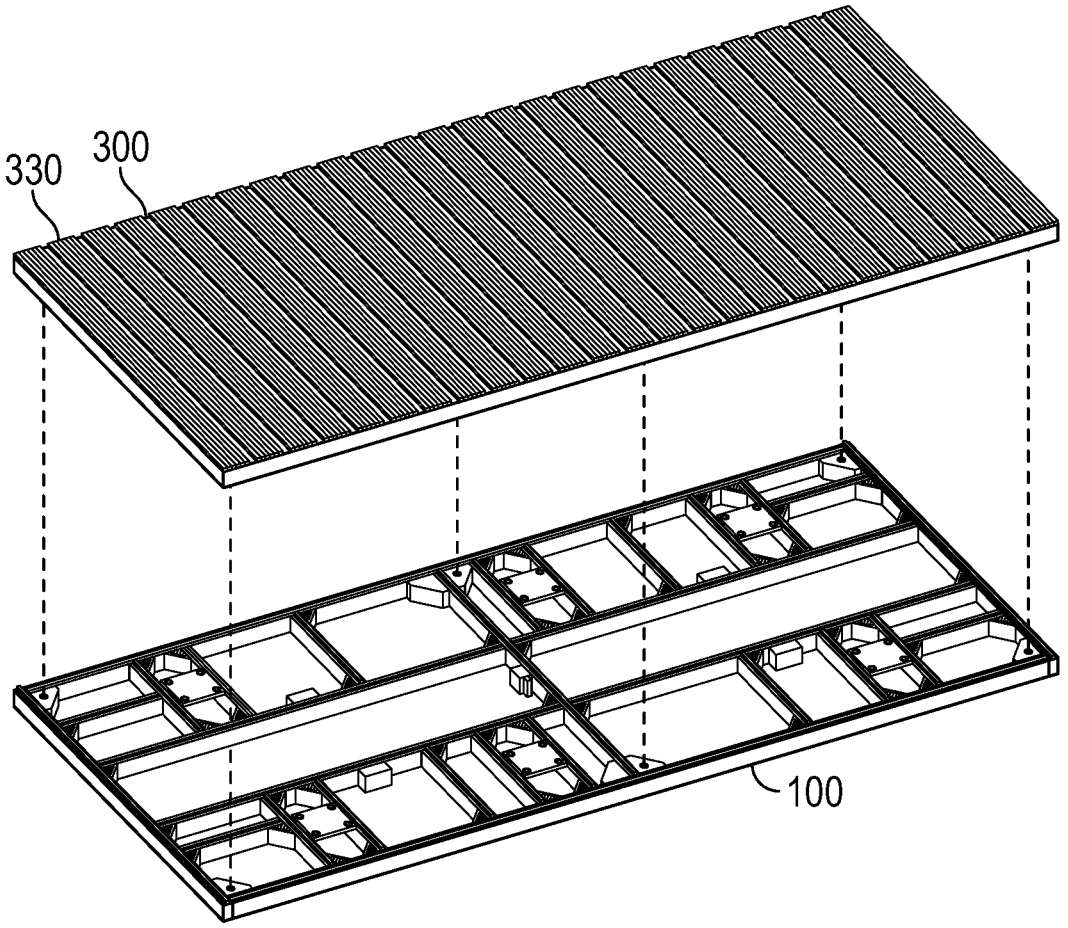
FIGS. 11*a*-11*b* are exemplary illustrations of two views of the invention in accordance with an embodiment of the invention regarding a golf stroke training apparatus, as well as methods and systems to train a golfer to improve golf strokes, including putting strokes, wherein the golf stroke training apparatus is shown, in the top view, the apparatus from the side showing the supporting frame and the planar putting surface covered in synthetic carpeting and, in the bottom view, the apparatus from the end where the golfer would stand facing towards the cup showing the supporting frame and the planar putting surface covered in synthetic carpeting and showing exemplary firmware and software (not shown) operably connected to the planar putting surface.
Figure 11B:
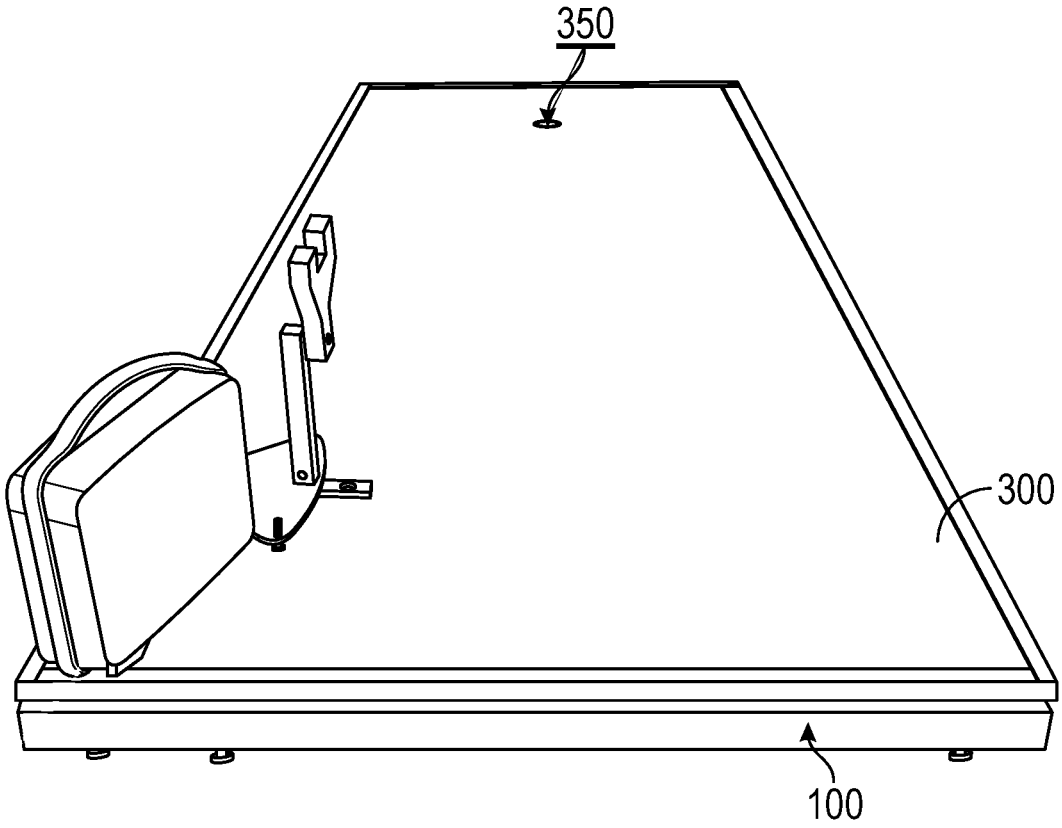

FIG. 4 shows the wiring layout in the junction boxes according to an embodiment. Junction box 121 comprises plug 181, cable 161 to a switch, cable 171 to actuator 131, plug 180 with ½" drilled hole for fuse holder, blue terminal 196 connected to red wire 203, brown terminal 195 connected to black wire 201, green terminal 194 connected to white wire 200, red terminal 193 connected to brown wire 205, yellow terminal 192 connected to green wire 204, black terminal 191 connected to blue wire 206, white terminal 190, and cable 151 to a control box 103.

While the foregoing disclosure, including the specification, the drawings, represent various embodiments of the invention and aspects of the invention, and objects of the invention, it is understood and recognized by one of ordinary skill in the art that various additions, modifications and substitutions may be made by one of ordinary skill in the art without departing from the spirit and scope of the principles of the invention, which is defined in the accompanying claims. The various and specific embodiments are therefore to be considered in all respects as illustrative and as examples and as not restrictive and as not limiting the invention. Many possible embodiments of the invention may be made and used and will be readily evident one of ordinary skill in the art upon examination of the disclosure of the invention herein, along with numerous features and sub-combinations of the invention that may be made and used without reference to other features and sub-combinations. Various objects, features, aspects and advantages of the invention will be readily evident to one of ordinary skill in the art upon examination of the description of the invention herein, including the specification, and the illustrative examples, and the drawings, and the appended claims.

What is claimed is:

1. A golf stroke training apparatus comprising:
- a planar golf stroke surface;
- a supporting frame connected to the bottom of the golf stroke surface;
- a plurality of actuators affixed to the golf stroke surface;
- a plurality of sensors configured to measure ground force reaction, stroke, ball launch, and ball distance;
- at least one control box;
- at least one inclinometer affixed to the golf stroke surface;
- at least one power supply;
- at least one arduino board;
- at least one microprocessor; and
- a cup provided on the golf stroke surface for receiving and configured to receive a golf ball;
- wherein the plurality of actuators, the plurality of sensors, the at least one control box, the at least one inclinometer, the at least one power supply, the at least one arduino board, and the at least one microprocessor are operably connected;
- wherein the at least one microprocessor is configured to electronically adjust the plurality of actuators; and
- wherein the golf stroke surface can be levelled statically a with respect to the supporting frame.

2. The golf stroke training apparatus of claim 1 wherein the supporting frame comprises a plurality of corner plates, a plurality of gussets, and extruded aluminum bracing.

3. The golf stroke training apparatus of claim 1 wherein the cup is positioned at least eighteen inches from a far end of the golf stroke surface.

4. The golf stroke training apparatus of claim 1 wherein the golf stroke surface is adjustable with respect to pitch, slope, and height.

5. The golf stroke training apparatus of claim 1 wherein the apparatus is configured to register at least one of full swing golf strokes and putting strokes.

6. The golf stroke training apparatus of claim 1 wherein the golf stroke surface is covered in synthetic grass.

7. The golf stroke training apparatus of claim 1 wherein the golf stroke surface is adjustable in quantifiable measurements to a resolution of less than about one-tenth of a degree of slope.

8. The golf stroke training apparatus of claim 1 wherein the golf stroke surface length is about at least eleven and a half feet.

9. The golf stroke training apparatus of claim 1 wherein the at least one microprocessor is configured using at least one of firmware and software to control a position of the golf stroke surface,
- wherein the statically leveled golf stroke surface can be adjusted by adding at least one of slope or pitch in quantifiable measurements, wherein the at least one of firmware and software are configured to facilitate measurement of ground force reaction, stroke, ball launch, and ball distance, wherein the at least one microprocessor is configured to control movement of the platform via the actuators, and wherein the at least one of firmware and software are configured to provide controls for:

changing roll, pitch, left/right slope, and up or down positioning based on movement of at least one of the plurality of actuators;

providing a zero pitch and zero roll golf stroke surface state;

moving the golf stroke surface to a static levels; and moving the golf stroke surface to fully retract all motors, and wherein the software provides at least one of a plurality of icons on a display to indicate the state of each actuator, and controls for saving parameters of a golf stroke taken on the golf stroke surface in a golfer user profile that may be stored in the software.

10. The golf stroke training apparatus of claim 9 wherein the plurality of sensors are further configured to measure weight distribution of a golfer standing on the golf stroke surface and ball roll.

11. The golf stroke training apparatus of claim 1 wherein the plurality of sensors are further configured to measure weight distribution of a golfer standing on the golf stroke surface and ball roll.

12. A method for golf stroke training with a golf stroke training apparatus comprising:

a planar golf stroke surface;

a supporting frame connected to the bottom of the golf stroke surface;

a plurality of actuators affixed to the golf stroke surface;

a plurality of sensors configured to measure ground force reaction, stroke analysis, stroke, ball launch, and ball distance;

at least one control box;

at least one inclinometer affixed to the golf stroke surface;

at least one power supply;

at least one arduino board;

at least one microprocessor; and a cup provided on the golf stroke surface and configured to receive a golf ball;

wherein the plurality of actuators, the plurality of sensors, the at least one control box, the at least one inclinometer, the at least one power supply, the at least one arduino board, and the at least one microprocessor are operably connected;

wherein the at least one microprocessor is configured to electronically adjust the plurality of actuators; and wherein the golf stroke surface can be levelled statically with respect to the supporting frame;

wherein the method comprises the steps of:

(a) using the golf stroke training apparatus to monitor a golfer standing on the golf stroke surface and making a putting stroke with a golf ball towards the cup;

(b) saving detected parameters of the putting stroke using the at least one microprocessor;

(c) analyzing the parameters of the putting stroke; and (d) providing feedback to the golfer based on the detected parameters.

13. The method of golf stroke training of claim 12 wherein the plurality of sensors are further configured to measure weight distribution of the golfer and ball roll.

* * * * *